US009170006B2

(12) United States Patent
Cugini et al.

(10) Patent No.: US 9,170,006 B2
(45) Date of Patent: Oct. 27, 2015

(54) LIGHT FIXTURE RECONFIGURABLE BETWEEN AREA LIGHTING AND SPOT LIGHTING CONFIGURATIONS

(71) Applicant: Foxfury, LLC, Vista, CA (US)

(72) Inventors: Mario A. Cugini, Vista, CA (US); Ralph L. Giusti, Vista, CA (US)

(73) Assignee: FOXFURY LLC, Oceanside, CA (US)

( * ) Notice: Subject to any disclaimer, the term of this patent is extended or adjusted under 35 U.S.C. 154(b) by 289 days.

(21) Appl. No.: 13/742,329

(22) Filed: Jan. 15, 2013

(65) Prior Publication Data

US 2013/0128565 A1 May 23, 2013

(51) Int. Cl.

| | |
|---|---|
| ***F21S 4/00*** | (2006.01) |
| ***F21V 19/02*** | (2006.01) |
| ***F21L 4/04*** | (2006.01) |
| ***F21L 19/00*** | (2006.01) |
| ***F21S 8/00*** | (2006.01) |
| ***F21S 13/10*** | (2006.01) |
| ***F21V 1/00*** | (2006.01) |
| ***F21V 11/00*** | (2015.01) |

(Continued)

(52) U.S. Cl.

CPC ..... *F21V 21/145* (2013.01); *F21L 4/02* (2013.01); *F21V 21/30* (2013.01); *F21V 21/06* (2013.01); *F21V 21/22* (2013.01); *F21V 29/75* (2015.01); *F21V 29/763* (2015.01); *F21W 2131/1005* (2013.01); *F21Y 2101/02* (2013.01); *F21Y 2105/001* (2013.01); *F21Y 2111/005* (2013.01)

(58) Field of Classification Search

CPC ..... F21V 21/22; F21V 21/30; F21V 21/145; F21V 14/025; F21V 29/02; F21V 14/045; F21V 14/065; F21S 6/006; F21S 6/008; F21S 10/006

USPC ..... 362/431, 403, 177, 190, 199, 220, 362/249.03, 238, 282, 287

See application file for complete search history.

(56) References Cited

U.S. PATENT DOCUMENTS

| | | | | |
|---|---|---|---|---|
| 8,072,123 | B1 * | 12/2011 | Han | 313/45 |
| 2009/0116210 | A1 * | 5/2009 | Cutler et al. | 362/8 |
| 2011/0122605 | A1 * | 5/2011 | Deighton et al. | 362/183 |

(Continued)

*Primary Examiner* — Y M Lee
*Assistant Examiner* — William N Harris
(74) *Attorney, Agent, or Firm* — Calif Tervo; Palomar Patent

(57) ABSTRACT

Light fixture comprises light panels hingedly connected and reconfigurable between area lighting, wherein their collective light is emitted horizontally substantially 360 degrees radially outward, and spot lighting, wherein their light-projecting directions are substantially in the same direction and their light outputs are the same. Light panels can be positioned between area and spot lighting configurations to produce any continuous arc of light output. In an alternate embodiment, light fixture is incorporated into a portable task light reconfigurable between a cylindrical configuration for transport and stowage and a use configuration for providing illumination, generally including a main body, stand to erect the body, a telescoping pole, and reconfigurable light fixture connected to top end of the pole.

11 Claims, 4 Drawing Sheets

(51) Int. Cl.

| | |
|---|---|
| ***F21V 17/02*** | (2006.01) |
| ***F21V 21/30*** | (2006.01) |
| ***F21V 21/14*** | (2006.01) |
| ***F21L 4/02*** | (2006.01) |
| *F21V 21/06* | (2006.01) |
| *F21V 21/22* | (2006.01) |
| *F21W 131/10* | (2006.01) |
| *F21Y 101/02* | (2006.01) |
| *F21Y 105/00* | (2006.01) |
| *F21Y 111/00* | (2006.01) |
| *F21V 29/75* | (2015.01) |
| *F21V 29/76* | (2015.01) |

(56) References Cited

U.S. PATENT DOCUMENTS

2012/0057333 A1* 3/2012 Bhardwaj et al. ..... 362/183
2013/0194805 A1* 8/2013 Lin et al. ..... 362/249.03

* cited by examiner

FIG. 6
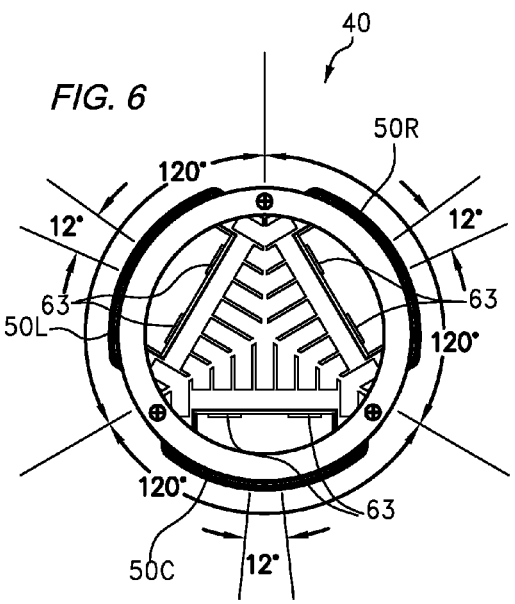
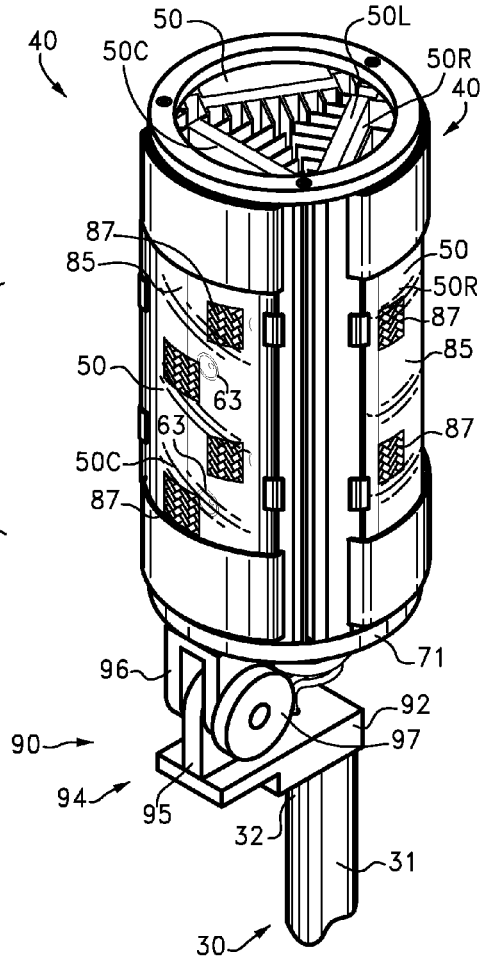
FIG. 3
FIG. 8
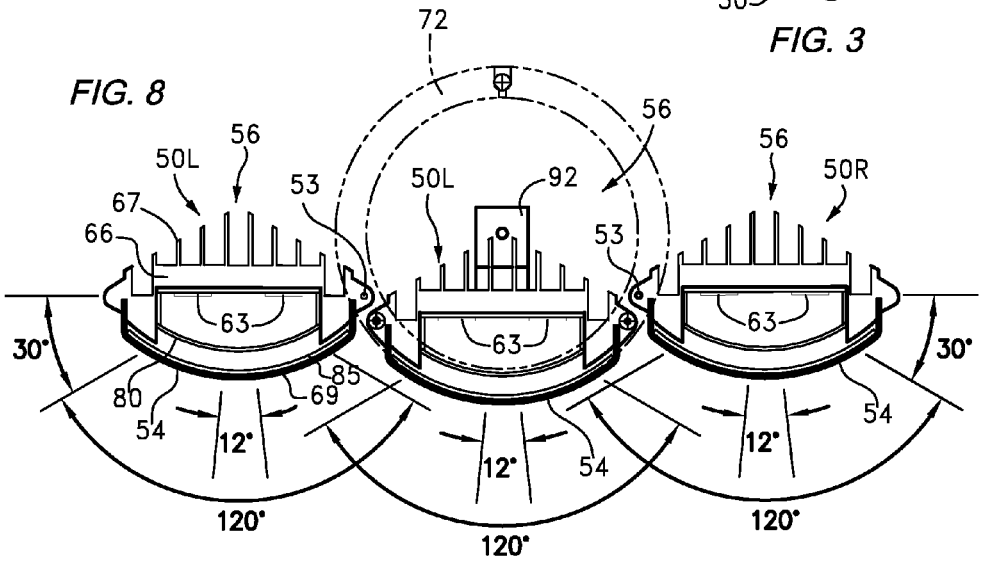

LIGHT FIXTURE RECONFIGURABLE BETWEEN AREA LIGHTING AND SPOT LIGHTING CONFIGURATIONS

FIELD OF THE INVENTION

This invention relates in general to light fixtures and more particularly to a reconfigurable light fixture for a portable task light

BACKGROUND OF THE INVENTION

High output portable lights have been developed to assist workers in the field, particularly emergency personnel, such as police and firefighters.

In many instances it is desirable to have a spot light for providing illumination in a specific direction, for example to illuminate the side of a burning building to see where people are trying to escape, or illuminate an area where a lighting device can't be placed.

In many instances it is desirable to have an area light for illuminating an area for multiple persons working on multiple tasks such as at a traffic accident or first aid or medical station.

These portable lights are often, of necessity, quite large because they commonly include a power source, such as batteries, that must last for a long time. Also, area lights, in particular, typically include a telescoping pole to elevate the light fixture well above the area to be illuminated to enlarge the lighted area and to prevent shadows as much as possible. These portable lights usually weigh in excess of forty pounds. The portable lights are typically stowed in an emergency vehicle.

Prior art light fixtures are configured to provide either area or spot illumination, such that more lights than may be necessary must be carried in the emergency vehicle or, because of size or weight limitations, a decision must be made as to which type of light to carry and hope the other is not needed.

SUMMARY OF THE INVENTION

This invention is a light fixture reconfigurable between area lighting and spot lighting configurations and emitting the same amount of light in either configuration. In an exemplary embodiment, it generally comprises three light panels hingedly connected to one another about vertical hinge axes. Each panel has an associated horizontal light-projecting direction and emits light from at least one light source in a horizontal arc, the arc being centered on the panel's light-projecting direction such that their collective light is emitted horizontally substantially 360 degrees radially outward. Preferably, three or more light panels are used.

The light panels are reconfigurable by rotation about their hinge axes to a spot lighting position wherein their light-projecting directions are substantially in the same direction and their light outputs are substantially the same.

Electrical power connected to the light panels powers the light sources.

In another exemplary embodiment, the light fixture is incorporated into a portable task light reconfigurable between a generally elongate cylindrical configuration for transport and stowage and in which the light fixture is in the area configuration and a use configuration for providing illumination. The task light generally includes a main body having a longitudinal axis, a stand connected to the main body and deployable to the use configuration to erect the body with the longitudinal axis vertical, a telescoping pole having a top end; the pole connected to the main body and selectively telescopingly deployable to the use configuration such that the top end of the pole is disposed well above the top end of the main body, and the reconfigurable light fixture connected to the top end of the pole.

In the described manner, a single task light or a single light fixture can serve as either an area light or a spot light without loss of light output.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 3 is an enlarged top, front, right side perspective view of the light fixture of the task light of FIG. 1 in the area lighting configuration.

FIG. 6 is a top diagrammatic view of the illumination pattern of the lighting fixture of FIG. 3.

FIG. 8 is a top diagrammatic view of the illumination pattern of the lighting fixture in the spot lighting configuration.

DETAILED DESCRIPTION OF THE INVENTION

Figure 1:
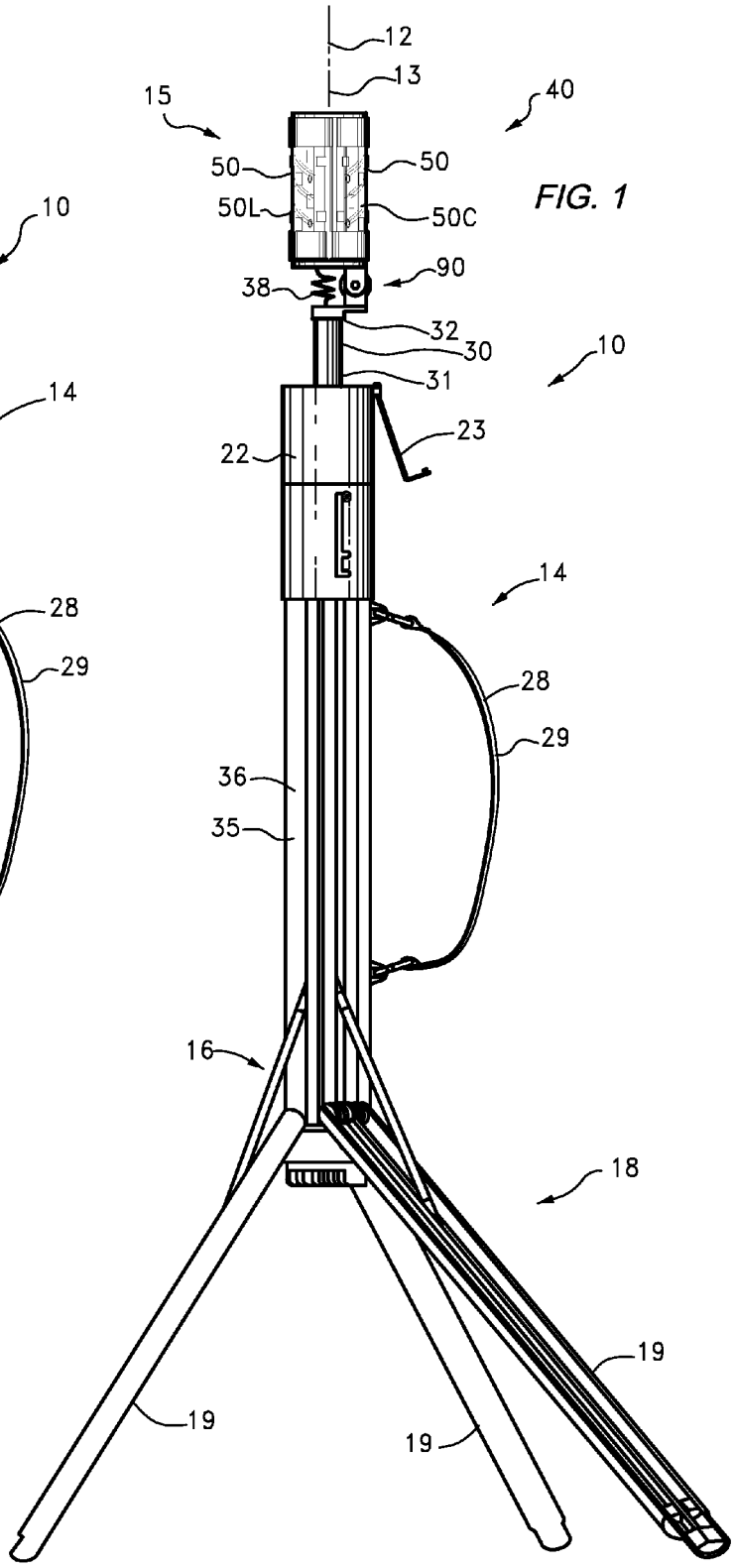
FIG. 1 is a side elevation view of an exemplary embodiment of a portable task light with the light fixture of the invention deployed in an area lighting configuration.
Figure 2:
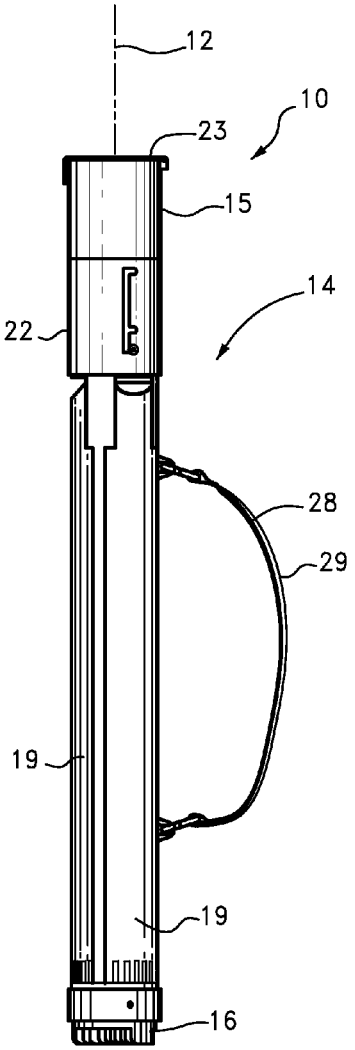
FIG. 2 is a side elevation view of the task light of FIG. 1 in a portable configuration.

With reference now to the drawings, and more particularly to FIGS. 1 and 2 thereof, there is shown a portable task light, denoted generally as 10, including a reconfigurable light fixture, denoted generally as 40. Task light 10 is a portable light, sometimes called a work light or scene light FIG. 1 is a side elevation view of an exemplary embodiment of the portable task light 10 in a working configuration with the light fixture 40 of the invention deployed in an area lighting configuration. FIG. 2 is a side elevation view of task light 10 of FIG. 1 in a generally elongate cylindrical storage configuration for transport and stowage, although other shapes could be implemented.

Task light 10 has a longitudinal axis 12 and a main body 14 having a top end 15 and a bottom end 16. Stand 18 is connected to main body 14 and includes deployable legs 19 for erecting task light 10 with axis 12 vertically as shown in FIG. 1. Main body 14 includes a power source 35, such as batteries 36, and circuitry including power wiring 38 for powering light fixture 40. A cover 22 covers top end 15 of task light 10 in the storage configuration and protects light fixture 40 during transport and stowage. In the exemplary embodiment, cover 22 is tubular structure including a lid 23. Lid 23 is selectively movable between a closed position, shown in FIG. 2, covering the top of light fixture 40 to protect it and keep out dirt, to an open position, shown in FIG. 1, allowing exposure of light fixture 40 and deployment of pole 30 and light fixture 40. Cover 22 is movable, such as being slidably mounted on main body 14 to expose light fixture 40.

Carrying means 28, such as a handle or carrying strap 29 is attached to main body 14 to facilitate transport.

A telescoping pole 30 is connected to main body 14. Telescoping pole 30 may be comprised of one or more sections. Only a top pole section 31 having a top end 32 is seen in the drawings. In the storage configuration of task light 10, pole 30 is in a retracted configuration housed in main body 14. In an extended position, pole 30 is telescopingly extended such that the top end 32 of top pole section 31 is disposed well above the top end of main body 14. In FIG. 1, pole 30 is shown only partly extended. Top section 31 is supported in lower pole sections so as to be readily rotatable about longitudinal axis 12 in a manner that is well-known in that art, such that, during use, light fixture 40 is readily rotatable about the vertical axis 13 by rotating pole 30 without having to move legs 19. Top end 32 of pole 30 includes support means, denoted generally as 90, for supporting light fixture 40.

FIG. 3 is an enlarged top, front, right side perspective view of light fixture 40 of task light 10 of FIG. 1 in the area lighting configuration which is also the cylindrical transport or stowage configuration of task light 10. Light fixture 40 generally comprises a plurality of light panels 50. In the exemplary embodiment, there are three light panels 50, center light panel 50C, left light panel 50L, and right light panel 50R, arranged in a circle.

Figure 4:
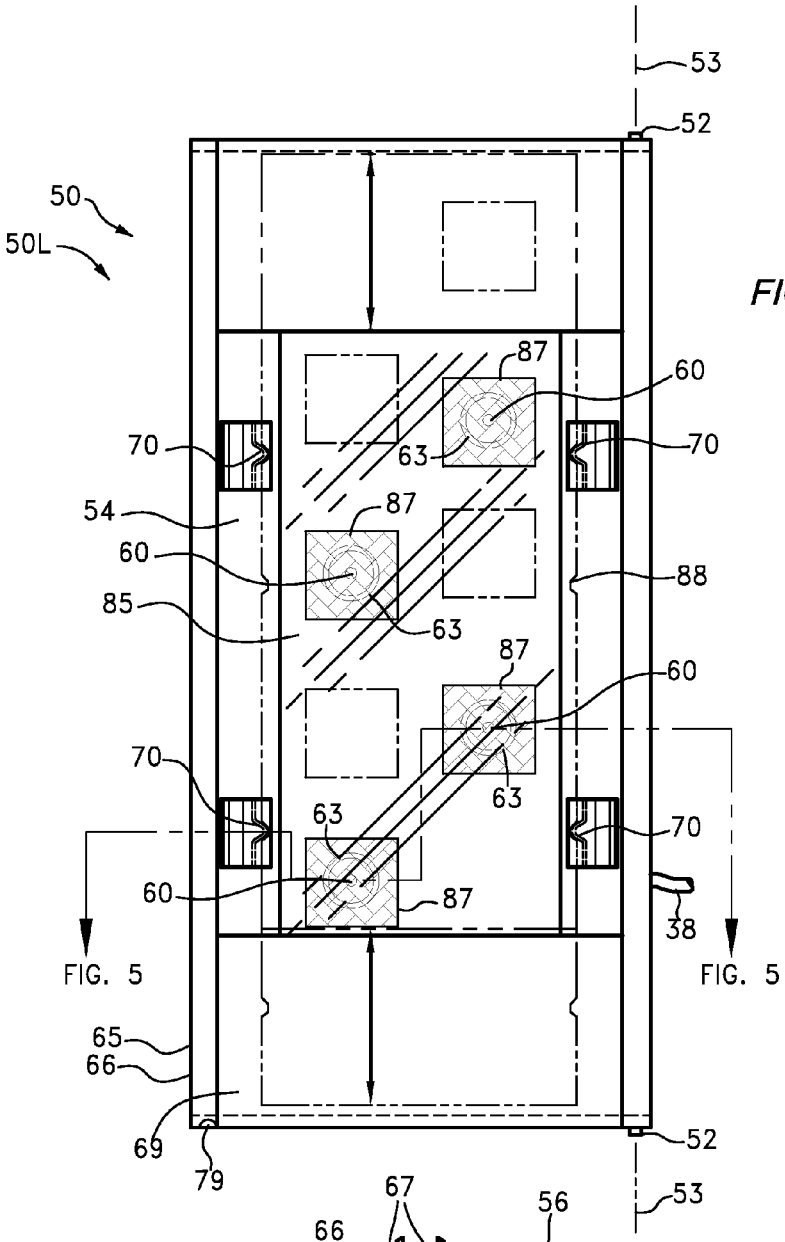
FIG. 4 is an enlarged front elevation view of the left light panel of the lighting fixture of FIGS. 1 and 3.
Figure 5:
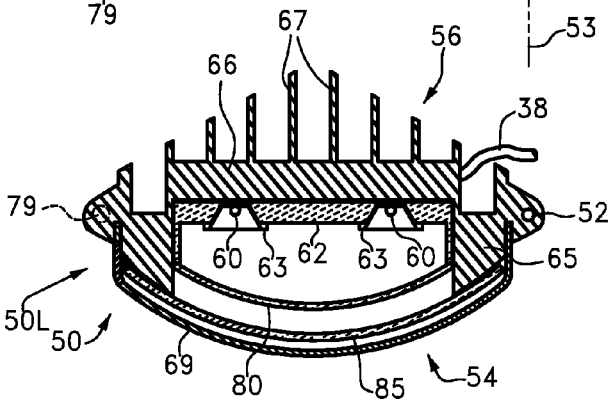
FIG. 5 is a sectional view taken on line 5-5 of the light panel of FIG. 4.

FIG. 4 is an enlarged front elevation view of an exemplary and representative light panel 50, namely left light panel 50L, of light fixture 40. FIG. 5 is a sectional view taken on line 5-5 of light panel 50 of FIG. 4. Light panel 50L is vertically elongate and includes a hinge means, such as including hinge pins 52, having a vertical hinge axis 53. As will be seen, light panels 50 are hingedly connected to one another about vertical hinge axes 53 for movement between spot and area lighting configurations. Each panel 50 has a front 54 and a back 56. Each panel 50 includes one or more light sources, such as the four high power LEDs 60 of the illustrative embodiment, on its front 54. LEDs 60 are mounted on a circuit board 62 and powered by power wiring 38 from power source 35, such as a battery or batteries 36 in main body 14. Each LED 60 has an associated reflector 63 for focusing or directing the emitted light into a desired pattern.

On back 56 of each light panel 50, a large heat sink 66 with vertical fins 67 in thermal contact with LEDs 60, conducts heat from LEDs 60 and transfers it to the atmosphere. In the exemplary embodiment, heat sink 66 also serves as a frame 65 upon which circuit board 62, hinge 52 and other components are mounted. A transparent lens, 80 mounted in front of reflectors 63, covers and protects LEDs 60.

A diffuser lens 85 is slidably mounted in front of transparent lens 80. Diffuser lens 85 is transparent except for diffuser areas 87. Diffuser lens 85 is vertically slidable by a user and includes detents, such as notches 88, cooperating with detents, such as springs 70 attached to frame 65 for retaining diffuser lens 85 in a selected vertical position. Top and bottom covers 69, mounted on frame 65, provide housings for receiving the bottom end and top end of diffuser lens 85 as it is slid up and down. Sliding diffuser lens 80 in one direction allows emitted light to pass freely though and sliding diffuser lens 85 in the other direction aligns diffuser areas 87 over LEDs 60 such that emitted light passes through diffuser areas 87 to spread out the light emitted from LEDs 60.

FIG. 6 is a top diagrammatic view of the horizontal illumination pattern of lighting fixture 40 in the area lighting configuration of FIG. 3. Area lighting is desirable when multiple tasks must be done throughout in a given area, such as at an accident scene. Each light panel 50 has an associated horizontal light-projecting direction to the front of each panel 50. Each light panel 50 emits light from LEDs 60 in a horizontal arc that is centered on the panel's light-projecting direction. In the area lighting position the collective light of light panels 50 is emitted horizontally radially outward substantially through all 360 degrees. In the exemplary embodiment, each of the three panels 50 illuminates its proportional share, i.e. one-third of the circle or 120 degrees. It may be desirable for some tasks to have a panel 50 emit more or less than a proportional share. In the area lighting configuration, fins 67 of heat sinks 66 are directed radially inward and surround the cooling air so as to create convection cooling for enhancing flow of cooling air flow over fins 67.

In the exemplary embodiment, LEDs 60 with reflectors 63 are configured to horizontally emit light through the clear areas of diffuser lens 85 in about a 12 degree arc. This allows each light panel 50 to provide bright light through a small arc. Diffuser areas 87 are designed to receive light from LEDs 60 and transmit it diffused over the wider arc, e.g. of 120 degrees. Thus the diffused light is less intense than the non-diffused light. Although three light panels 50 shown and described, other numbers of light panels 50 could be used according to the above-described concept.

Figure 7:
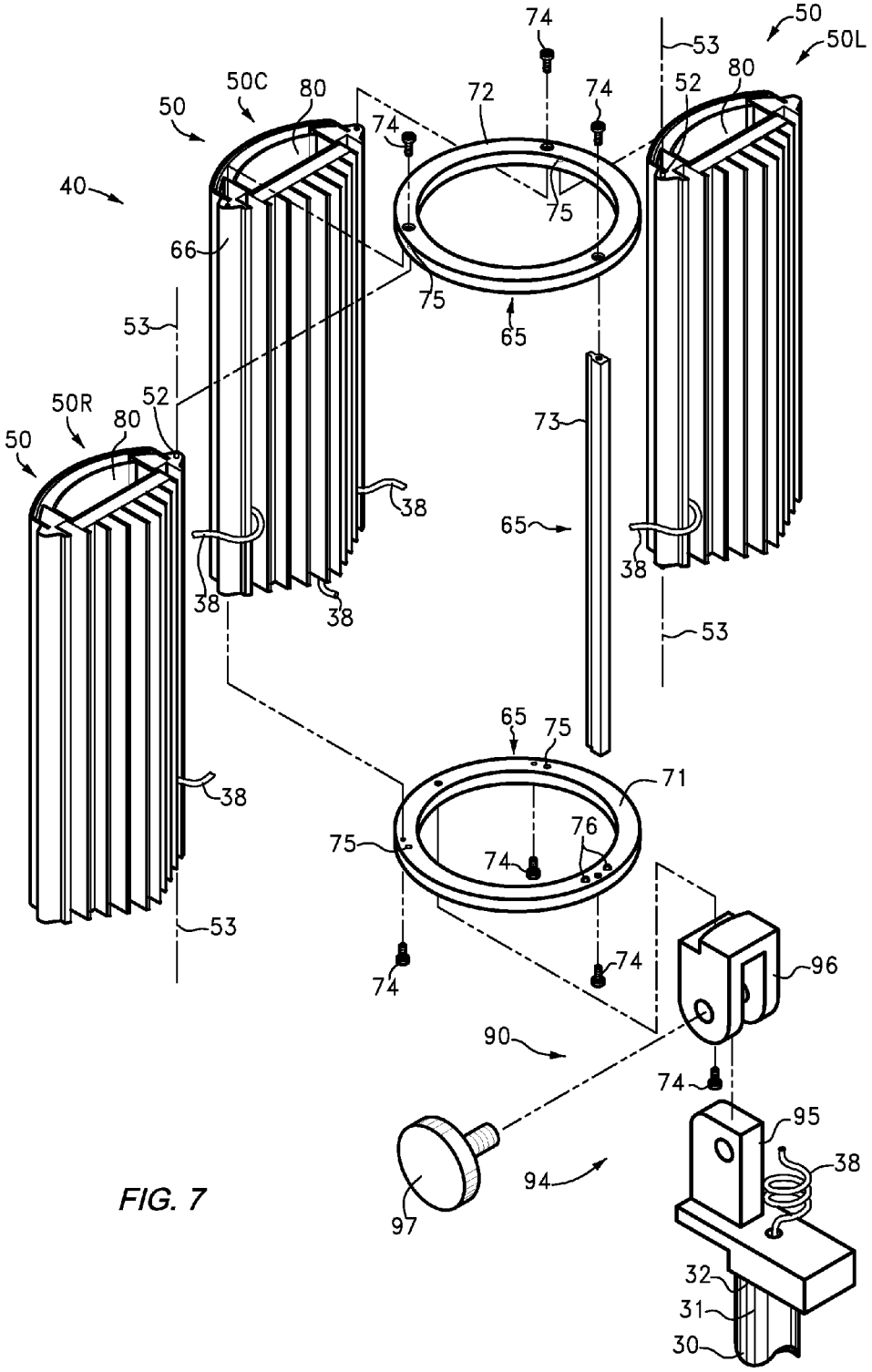
FIG. 7 is an enlarged exploded, top, rear, right side perspective view of the light fixture of the task light of FIG. 3 in the spot lighting configuration. Note that in this configuration it can also be used as an area light.

FIG. 7 is an enlarged exploded, top, rear, right side perspective view of light fixture 40 of task light 10 of FIG. 1 in the spot lighting configuration wherein the light-projecting directions of all panels 50 are substantially in the same direction. In the exemplary embodiment, frame 65 of center light panel 50C includes a bottom disk 71, a top disk 72, and a rear support 73 connecting them. Disks 71, 72 are attached, such as by screws 74 to the remainder of center panel 50C, such as to heat sink 66.

Light panels 50 are hingedly connected to one another about vertical hinge axes 53 such that the panels 50 are reconfigurable by rotation about their hinge axes 53 to the spot lighting position wherein their light-projecting directions are substantially in the same direction. In the exemplary embodiment, bores 75 in bottom and top disks 71, 72 receive hinge pins 52 of right and left panels 50R, 50L to allow for the rotation. Preferably, panels 50L, 50R are biased to the area configuration by detent means such as detent balls 76 in disk 71 cooperating with bores 79 in bottom of free side of light panels 50L, 50R as seen in FIG. 4, in.

As best seen in FIG. 3 Or 7, a support means, denoted generally as 90, on top end 32 of pole 30 connects light fixture 40 to the main body 14. Support means 90 includes a dog leg 92 attached to pole top end 32 and a pivot assembly 94 connecting an outer end of dog leg 92 to frame 65 of center panel 50C such as to bottom disk 71. Pivot assembly 94 includes a boss 95 and a yoke 96 having bores for receiving a joining and adjustment bolt 97. Pivot assembly 94 allows light fixture 40 to be tilted relative to longitudinal axis 12 of main body 14. This is particularly advantageous for light fixture 40 in the spot configuration.

FIG. 8 is a top diagrammatic view of the illumination pattern of lighting fixture 40 in the spot lighting configuration of FIG. 7. Spot lighting is desirable to illuminate an object or scene from a given direction, such as illuminating a building to see where people are trying to escape. Left and right panels 50L, 50R have been rotated about hinge axes 53 to the spot lighting position wherein their light-projecting directions are substantially in the same direction with substantially the same horizontal arc of illumination as a single light panel 50 except with three times the light intensity. In the diffused light output configuration, each light panel 50 emits light through a horizontal arc proportional to that panel's physical portion of the 360 degrees of the area configuration. Thus, the three equal size panels 50L, 50C, 50R, shown, each have diffused light output of substantially 120 degrees. Light panels 50 can be positioned between the area and spot configurations so as to produce any desired continuous horizontal arc of light output. Any panel 50 can be adjusted via the diffuser lens 85 to emit focused or diffused light.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A light fixture reconfigurable between an area lighting configuration and two spot lighting configurations comprising:

a plurality of light panels hingedly connected to one another about vertical hinge axes; each said panel having a front, a back and an associated light-projecting direction; said front of each panel including: a light source configured for emitting light in a first horizontal arc in said panel's light-projecting direction; and a diffuser lens selectively movable between a first position not obstructing said light source to a diffusing position in the path of the light wherein the light of each said panel is diffused and emitted in a horizontal arc at an angle of 360° divided by the number of panels; such that said panels, with said diffuser lenses in the diffusing position; are reconfigurable; by rotation about their hinge axes between an area lighting configuration wherein the collective light is emitted horizontally 360° radially outward and a first spot lighting configuration wherein their light is projected substantially in the same direction; and said panels are reconfigurable between the first spot lighting configuration and a second spot light configuration wherein their light is projected substantially in the same direction in the first horizontal arc by moving said diffuser lens to the first position; and electrical power means connected to said light panels for powering said light sources.

2. The light fixture of claim 1 wherein:

the light output of said light fixture in the area lighting configuration equals the light output of said light fixture in the spot lighting configuration.

3. The light fixture of claim 1 comprising:

three or more light panels.

4. The light fixture of claim 1 wherein:

said light panels are configurable to collectively emit light horizontally radially substantially through all angles between 360 degrees and the spot lighting position.

5. A portable task light reconfigurable between a generally elongate cylindrical configuration for transport and stowage and a use configuration for providing illumination including:

a main body having a longitudinal axis including:

a top end;

a bottom end;

a stand connected to said main body and deployable to the use configuration to erect said body with the longitudinal axis vertical;

a telescoping pole having a top end; said pole connected to said main body and selectively telescopingly deployable to the use configuration such that said top end of said pole is disposed well above said top end of said main body; and a light fixture connected to said top end of said pole reconfigurable between an area lighting configuration and two spot lighting configurations comprising:

a plurality of light panels hingedly connected to one another about vertical hinge axes; each said panel having a front, a back and an associated light-projecting direction; said front of each panel including: a light source configured for emitting light in a first horizontal arc in said panel's light-projecting direction; and a diffuser lens selectively movable between a first position not obstructing said light source to a diffusing position in the path of the light wherein the light of each said panel is diffused and emitted in a horizontal arc at an angle of 360° divided by the number of panels; such that said panels, with said diffuser lenses in the diffusing position, are reconfigurable, by rotation about their hinge axes between an area lighting configuration wherein the collective light is emitted horizontally 360° radially outward and a first soot lighting configuration wherein their light is projected substantially in the same direction; and said panels are reconfigurable between the first spot lighting configuration and a second spot light configuration wherein their light is projected substantially in the same direction in the first horizontal arc by moving said diffuser lens to the first position; and electrical power means connected to said light panels for powering said light sources.

6. The portable task light of claim 5 wherein:

the light output of said light fixture in the area lighting configuration equals the light output of said light fixture in the spot lighting configuration.

7. The portable task light of claim 5 comprising:

three or more light panels; each said panel having a back having a heat sink in thermal contact with said light source of said panel such that in the area lighting configuration said heat sinks are radially inward so as to create a chimney effect for enhancing flow of cooling air flow over said heat sinks.

8. The portable task light of claim 7 wherein:

the light output of said light fixture in the area lighting configuration equals the light output of said light fixture in the spot lighting configuration.

9. The table task light of claim 5 wherein:

said light panels are configurable to collectively emit light horizontally radially substantially through all angles between 360 degrees and the spot lighting position.

10. The light fixture of claim 1 wherein:

the first horizontal arc is about 12°.

11. The portable task light of claim 5 wherein:

the first horizontal arc is about 12°.

* * * * *